United States Patent [19]

Cole

[11] 4,368,804

[45] Jan. 18, 1983

[54] CHECK OUT LANE DISPLAY BARRIER

[75] Inventor: William A. Cole, Wyncote, Pa.

[73] Assignee: Diane Mfg. Co., Philadelphia, Pa.

[21] Appl. No.: 209,245

[22] Filed: Nov. 21, 1980

[51] Int. Cl.[3] ..... A47D 5/00

[52] U.S. Cl. ..... 186/57; 312/201

[58] Field of Search ..... 186/57, 69; 211/150; 312/252, 322, 300, 298, 201

[56] References Cited

U.S. PATENT DOCUMENTS 748,446 12/1903 Waite ..... 312/201

1,544,949 11/1921 Smiley .

1,675,545 4/1927 Goss .

3,053,602 9/1962 Golenpaul ..... 312/201

*Primary Examiner*—Stanley H. Tollberg

*Attorney, Agent, or Firm*—Seidel, Gonda, Goldhammer & Panitch

[57] ABSTRACT

A check out lane is defined along one side by a stationary shelf display and a movable shelf display. The movable display is pivotable from a position parallel to a lane to a position blocking the lane and is then reciprocal along the lane in a direction away from the stationary display so that it does not block access to shelves on the stationary display.

10 Claims, 10 Drawing Figures

FIG. 1
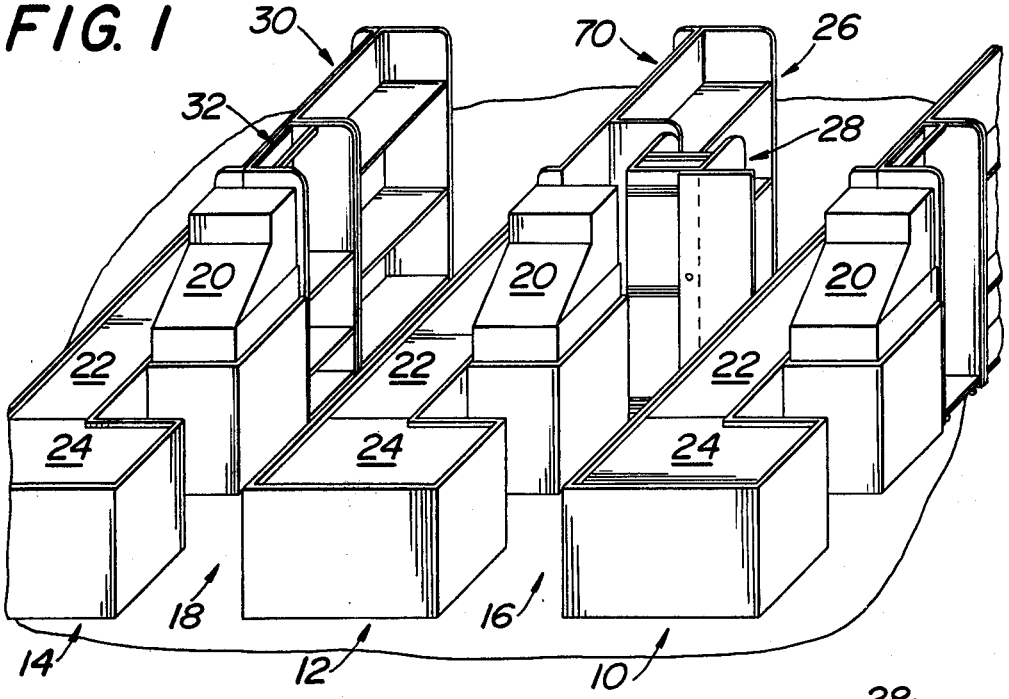
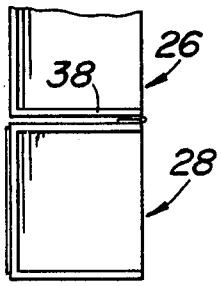
FIG. 2
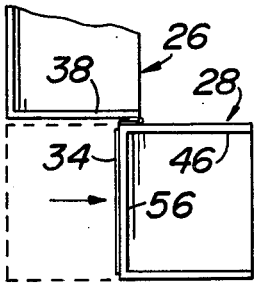
FIG. 3
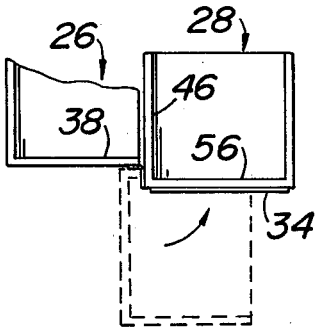
FIG. 4
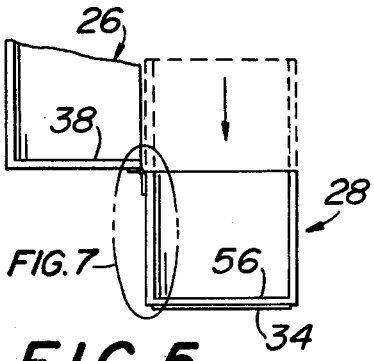
FIG. 5
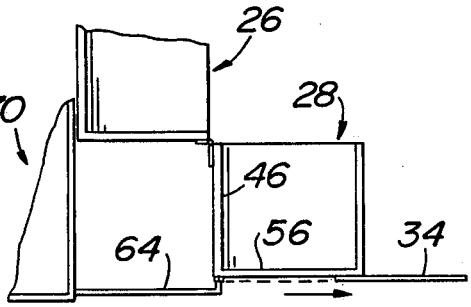
FIG. 6

FIG. 10
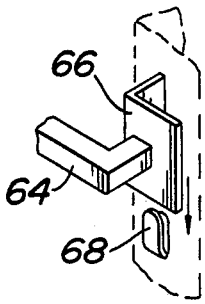
FIG. 7
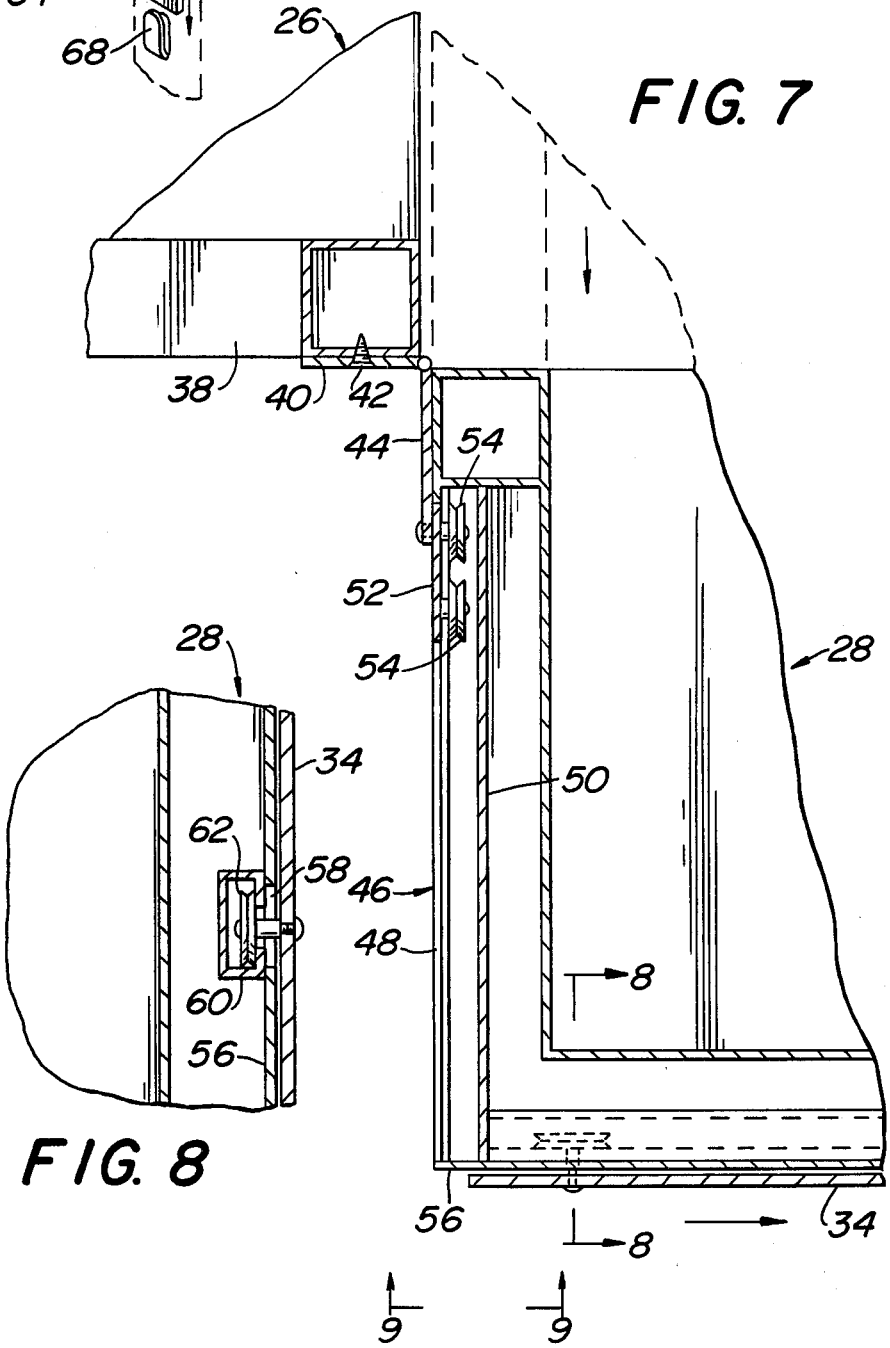
FIG. 8

CHECK OUT LANE DISPLAY BARRIER

BACKGROUND

It is known to block one or more lanes at check out counters by a chain, a wheeled basket, a portable shelf, etc. Such lane barriers are unsightly, are easily avoided, and constitute an inefficient or unsophisticated use of valuable floor space.

This invention solves that problem in a simple and efficient manner.

SUMMARY OF THE INVENTION

The check out lane barrier of the present invention includes a barrier for use along a check out lane. The barrier is comprised of a stationary shelf display and a movable shelf display. The movable shelf display can be pivoted to a lane blocking position and then can be reciprocated along the lane away from the stationary display so that it does not block access to shelfs on the stationary display.

The preferred embodiment has features such as a slidable door on the movable display for accommodating to different widths of lanes and a means for locking the movable display in a lane blocking position.

It is an object of the present invention to provide a display shelf having two display positions while acting as a lane barrier in a check out lane.

It is another object of the present invention to provide a more sophisticated merchandising concept for check out lanes.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of two check out lanes in a conventional merchandising establishment.

FIG. 2 is a partial plan view of display shelves along one of the check out lanes.

FIG. 3 is a top plan view showing movable portion of the display shelves reciprocated to a partial lane blocking position.

FIG. 4 is a view similar to FIG. 3 but showing the movable display pivoted to a lane blocking position.

FIG. 5 is a view showing the movable display reciprocated along the lane while in a lane blocking position.

FIG. 6 is a view similar to FIG. 5 but showing the movable display with its slidable door moved to an operative lane blocking position.

FIG. 7 is a sectional view as shown by the elipse in FIG. 5 but on an enlarged scale.

FIG. 8 is a sectional view taken along the line 8—8 in FIG. 7.

FIG. 10 is a partial perspective view of bracket means for locking the movable display in a lane blocking position.

DETAILED DESCRIPTION

Figure 9:
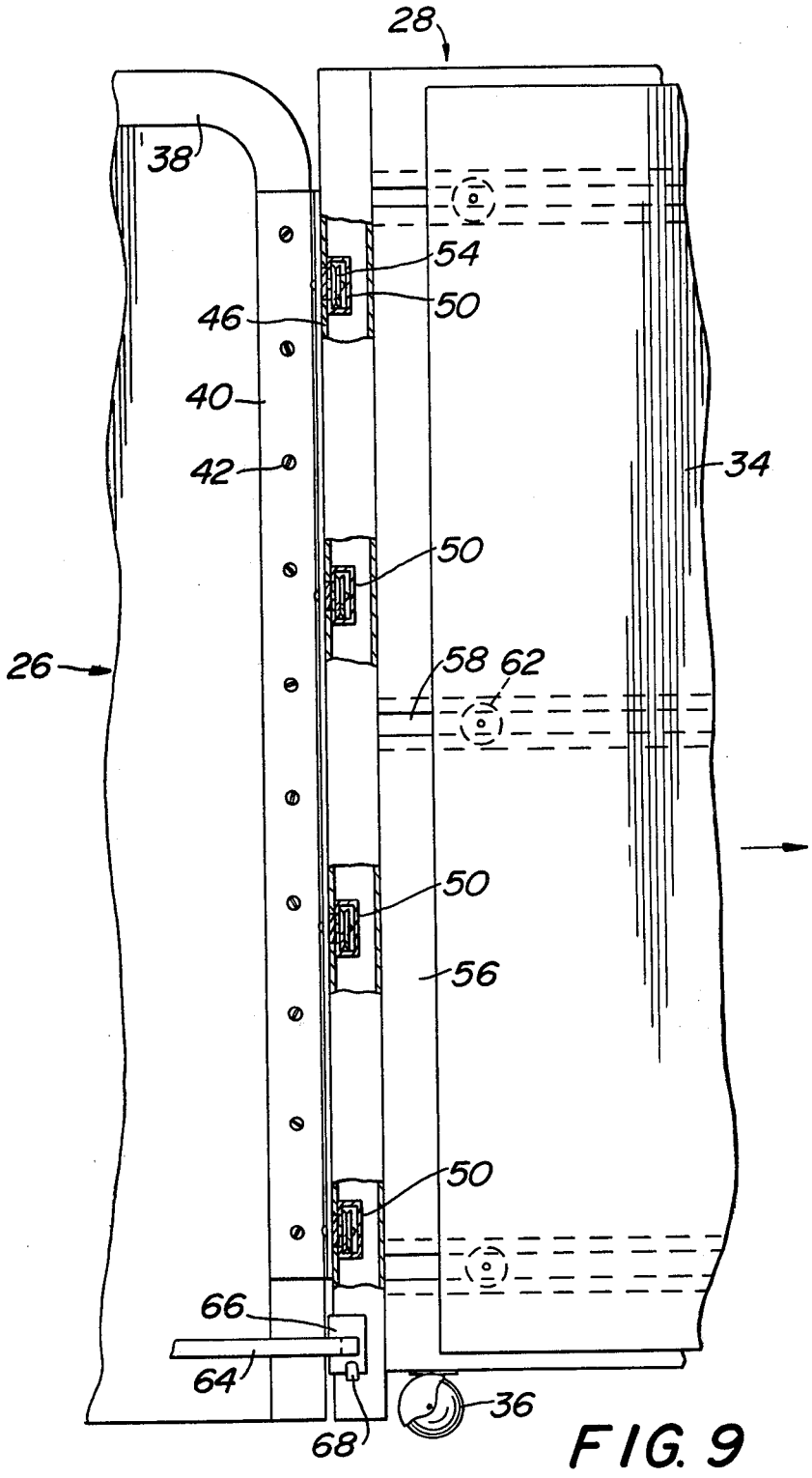
FIG. 9 is a sectional view taken along the line 9—9 in FIG. 7.

As shown in FIG. 1, there is provided a plurality of check out counters designated 10, 12, and 14. Between the check out counters 10 and 12, there is provided a check out lane 16. Between the check out counters 14, there is provided a check out lane 18. Upstream from the check out counters 10 and 12, alongside the lane 16, there is provided a stationary shelf display 26 for displaying merchandise and an associated movable shelf display 28. The display 28 has been shown minipulated to a lane blocking position. In connection with the upstream end of lane 18, there is shown a comparable stationary shelf display 30 and a movable shelf display 32. Shelf display 32 corresponds to shelf display 28 but shelf display 32 is shown in a normal operating position wherein lane 18 is open while shelf display 28 is shown in the position wherein lane 16 is closed.

The operative positions of shelf display 28 will be utilized to describe the present invention and are exemplary of the structure associated with each of the check out lanes. As shown in FIG. 2, the movable display 28 is aligned with the display 26 when the lane 16 is open. As shown in FIG. 3, the movable display 28 is supported for reciprocation in a direction perpendicular to its associated lane 16 to a lane blocking position. As shown in FIG. 4, a movable shelf display 26 is pivotable about a vertical axis into a different lane blocking position. As shown in FIG. 5, the display 28 is supported for reciprocation in a direction along the lane 16 while remaining in a lane blocking position. As shown in FIG. 6, the movable shelf display 28 has a barrier 34 which is supported by the shelf display 28 for reciprocation between an inoperative and an operative position. The barrier 34 enables the apparatus of the present invention to accommodate itself to various different widths of lanes in various commercial establishments.

The shelf display 28 is supported by a plurality of swivel casters 36. Display 26 is provided with a frame 38. A hinge has one leg 40 fixedly secured to frame 38 by fasteners 42. See FIGS. 7 and 9. The other leg 44 of the hinge partially overlies a side wall 46 on the shelf display 28. Wall 46 is provided with a slot 48 at spaced locations along its height. At each of the slots 48, there is provided a track 50 within the shelf display 28. At the location of each slot and track, the hinge leg 44 is provided with an extension plate 52. Each extension plate 52 corresponds generally to the height of the slots 48 and supports one or more wheels 54 which are disposed within the tracks 50. When constructed in this manner, the shelf display 28 may pivot from the position shown in FIG. 3 to the position shown in FIG. 4. In addition, shelf display 28 may reciprocate with respect to the hinge leg 44 and shelf display 26 as shown in FIGS. 3 and 5.

The rear wall 56 of the shelf display 28 is provided with a plurality of horizontal slots 58. A track 60 is provided within the rear wall 56 for each of the slots 58. See FIG. 8. The barrier 34 is provided with a plurality of wheels 62 which ride within one of the tracks 60.

In order that customers may not push the display 28 out of the way, a latching means is provided for latching the display shelves 26, 28 in the position as shown in FIG. 6. As shown more clearly in FIGS. 9 and 10, a bracket 64 is provided with a L-shaped latch 66 at one end. Latch 66 is retained in position by a retainer 68 on the rear wall 56 near the lower end thereof. The other end of bracket 64 is pivoted to a wall on the shelf display 70. Display 70 is positioned back to back with respect to the displays 26, 28. Merchandise on display 70 is accessible from the lane 18.

The manner in which the present invention is utilized should be readily apparent from the above description and the illustrations and the drawings. Let it be assumed that it is desired to close off lane 16. Display 28 is reciprocated from the position shown in FIG. 2 to the position shown in FIG. 3. The shelf display 28 rolls on the casters 36 and the wheels 54 ride in the tracks 50 so as to be adjacent to the rear wall 56. Thereafter, shelf display 28 is pivoted 90° to the solid line position shown in FIG. 4. Thereafter, shelf display 28 is reciprocated along the lane 16 while the wheels 54 move to the opposite end of the tracks 50 to the position as shown in FIG. 7. Thereafter, the barrier 34 may be reciprocated to close off any remaining portion of the lane 16 and the latching bracket 64 is minipulated to a blocking position wherein the display 28 may neither pivot nor reciprocate. With the display 28 in the position as shown in FIGS. 1, 6 and 7, it will be noted that the articles on each shelf of the displays 26 and 28 are accessible to customers. Thus, the shelf display 28 performs the added function of being a lane barrier.

The present invention may be embodied in other specific forms without departing from the spirit or essential attributes thereof and, accordingly, reference should be made to the appended claims, rather than to the foregoing specification, as indicating the scope of the invention.

I claim:

1. A check out lane barrier for use along a check out lane comprising a stationary shelf display and a movable shelf display, means for enabling said movable display to be pivotable about an upright axis through an arc of approximately 90° relative to the stationary display to a lane blocking position and also reciprocate along the lane away from the stationary display.

2. A check out lane barrier (apparatus) in accordance with claim 1 in combination with a check out counter and cash register along the check out lane, said movable display being between said stationary display and said cash register.

3. A check out lane barrier in accordance with claim 1 including a barrier door slidably supported by said movable display for reciprocation in a direction perpendicular to the lane and for cooperation with the movable display in blocking the entirety of the lane.

4. A check out lane barrier in accordance with claim 1 wherein the movable display is connected to the stationary display by a hinge, one leg of the hinge having wheels disposed along a track supported by the movable display to facilitate reciprocation of the movable display with respect to the hinge.

5. Apparatus comprising a pair of parallel check out counters, each check out counter having an article conveyor and a cash register, said check counters being spaced from one another by a lane, first and second merchandise displays upstream of one of the cash registers and having shelves exposed to said lane, said first display being stationary, said second display being reciprocably and pivotably connected to said first display in a manner so that the second display may be moved to a position wherein it blocks the lane and then reciprocated so that the second display does not prevent access to the shelves on the first display.

6. Apparatus in accordance with claim 5 wherein the movable display is connected to the stationary display for pivotable movement through an angle of 90° by a hinge, one leg of the hinge having wheels guided along a track supported by the movable display to facilitate reciprocation of the movable display with respect to the hinge.

7. Apparatus in accordance with claim 6 including a barrier door slidably supported by said movable display for reciprocation in a direction perpendicular to the lane and for cooperation with the movable display in blocking the entirety of the lane.

8. A check out lane barrier for use along a check out lane comprising a stationary shelf display and a movable shelf display disposed alongside one another, each display facing a first direction so that goods thereon are accessible by a person in the lane, means supporting the movable display for movement to a position so as to be generally perpendicular to the stationary display and for facilitating movement of the movable display in a second direction which is generally perpendicular to said first direction so that the movable display does not conceal any portion of the shelves on the stationary display.

9. A check out lane barrier in accordance with claim 8 wherein said means is arranged so as to first facilitate reciprocating the movable display in said first direction and then facilitate pivoting the movable display through an arc of approximately 90° and then facilitate reciprocating the movable display in said second direction for a distance corresponding generally to the depth of the movable display.

10. Apparatus comprising a check out counter and a cash register on one side of a check out lane, first and second aligned shelf displays supported by a floor on the other side of the lane in a manner so that shelves on each display are accessible from the lane, means for enabling said second display to also function as a barrier for said lane without interfering with said access to shelves on said second display, said means including a hinge device enabling said second display to pivot about a vertical axis through an arc of approximately 90° relative to said first display to a position wherein the second display cooperates with said check out counter to temporarily block said lane.

* * * * *